US005573406A

United States Patent [19]

Fowler

[11] Patent Number: 5,573,406

[45] Date of Patent: Nov. 12, 1996

[54] METHOD AND SYSTEM FOR DISPLAYING SYMBOLS REPRESENTING INDICIA OF TRAITS IDENTIFYING TRENDS FOR A PARTICIPANT IN A BOXING EVENT

[76] Inventor: Carl Fowler, 1545 W. 120th St., Chicago, Ill. 60643

[21] Appl. No.: 57,737

[22] Filed: May 5, 1993

[51] Int. Cl.[6] ..... G09B 25/00

[52] U.S. Cl. ..... 434/207; 434/118; 482/902; 395/887; 364/221.3; 364/221.4; 364/226.2; 364/DIG. 1

[58] Field of Search ..... 395/275, 600, 395/650, 62, 887; 364/410, 411; 434/247, 118, 307 R; 482/83, 900, 901, 902; 273/85 R, 433, 434, 440, DIG. 28

[56] References Cited

U.S. PATENT DOCUMENTS

| | | | |
|---|---|---|---|
| 3,735,505 | 9/1975 | Stein | 434/355 |
| 4,763,284 | 8/1988 | Carlin | 364/550 |
| 4,824,107 | 4/1989 | French | 273/1 |
| 4,941,660 | 7/1993 | Winn et al. | 272/76 |

FOREIGN PATENT DOCUMENTS

| | | |
|---|---|---|
| 0207782 | 3/1984 | Germany . |
| 0710556 | 1/1980 | U.S.S.R. . |

*Primary Examiner*—Thomas G. Lee
*Assistant Examiner*—Sang H. Kim
*Attorney, Agent, or Firm*—David C. Brezina; Lee, Mann, Smith, McWilliams, Sweeney & Ohlson

[57] ABSTRACT

A method and system for uniquely identifying indicia of traits of a participant in an event adapted for use in a boxing match. A plurality of predetermined characteristic corresponding to the traits of a participant to be identified is assigned. Each predetermined characteristic has a predefined format. The assigned characteristic is stored and displayed in a plurality of predefined display format allowing for identification of traits so as to facilitate interpretation and prediction of trends.

13 Claims, 3 Drawing Sheets

FIG. 3

70

74 INTRODUCTORY SCREEN

FIGHT DATA

BOXER NAME JOE SMITH CORNER BLUE
OPPONENT NAME ED JONES SCHEDULED ROUNDS 8
FIGHT DATE 08/28/92
FIGHT LOCATION CHIG, ILL. 76 72

BOXERS DATA

WEIGHT 139 HEIGHT 5'4" RIGHT LEFT HANDED R
REACH 64" AGE 30 HOME TOWN JACKSON TENN.

FIGHT RECORD DATA

WON 37 LOST 7 DRAW 1 KO'S 21

78 F2=SAVE F3=EDIT F4=ABORT/NO SAVE

FIG. 4

80

ROUND FIGHT SCREEN
RIGHT HANDED SMITH JOE 1 2 3 4 5
1234567890123456789012345678901234567890123456789 0

82 1ST MINUTE 86
92 3616-141
2ND MINUTE 88
92 442 (12) 1
3RD MINUTE 90
92 23 (34) (12) KO 94
84

1 2 3 4 5
1234567890123456789012345678901234567890123456789 0

F2= ROUND COMPLETE F3= FIGHT COMPLETE

METHOD AND SYSTEM FOR DISPLAYING SYMBOLS REPRESENTING INDICIA OF TRAITS IDENTIFYING TRENDS FOR A PARTICIPANT IN A BOXING EVENT

FIELD OF THE INVENTION

The invention relates to a method and system of identifying characteristics of a participant and more particularly to an improved tool for use in coaching and competing in a boxing match.

DESCRIPTION OF THE PRIOR ART

The prior art includes systems for judging boxing matches. Certain systems are used in amateur boxing matches for counting the number of punches landed or hits taken by a participant. Other systems have been used to judge professional matches wherein these compare punches thrown, punches that connect and input by scoring judges for forming a decision in the event. However, these systems have disadvantages and do not provide ongoing analytical information to identify characteristics or traits of participants in these events as distinguished from judging a boxing match, namely winning or losing. In addition, some systems can input and record objective data for ranking purposes such as, for example, the physical properties of a boxer, ratings, judge's points, and other physical factors such as time and force from a hit. These systems have disadvantages in providing either a narrow range of data or conclusory information not enabling the overview and prediction which the invention provides to draw conclusions and to change tactics in anticipation such as during in an event. Thus a need exists for a method and system for entering and storing in such a manner as to result in displaying an output to facilitate analysis and to provide a means for identifying traits and trends.

SUMMARY OF THE INVENTION

An object of the present invention is to provide a method and system for identifying traits of participants in events that overcome many of the problems of the prior art.

Another object of the present invention is to provide ongoing analytical information to identify a predetermined characteristic corresponding to the traits of a participant in an event. The predetermined characteristic features a predefined format.

An additional object of the present invention is to provide a simplified input means enabling increased ease of learning and efficient entry of data.

A further object of the present invention is to provide a plurality of predefined display formats allowing for increased identification of traits so as to facilitate interpretation and prediction.

It is yet another object of the present invention to provide an improved coaching tool for coaching participants in events such as in boxing matches.

In brief, the present invention provides for a method and system for identifying indicia of trends of a participant in an event having an input device for inputting a plurality of predetermined characteristics. The input device can be actuated upon the occurrence of each of the predetermined characteristics. A processor is used for processing each of the entered predetermined characteristics thereby converting and outputting a plurality of symbols corresponding to the inputted predetermined characteristics. A display is used for displaying the symbols in a plurality of predefined display formats. These display formats provide an improved means for identifying traits of the participant in the event.

BRIEF DESCRIPTION OF THE DRAWINGS

These and other objects and advantages of the present invention will become readily apparent upon consideration of the following detailed description and attached drawings, wherein:

FIG. 3 illustrates an introductory display of the present invention;

FIG. 4 illustrates a fight display of the present invention;

DETAILED DESCRIPTION OF THE DRAWINGS

Figure 1:
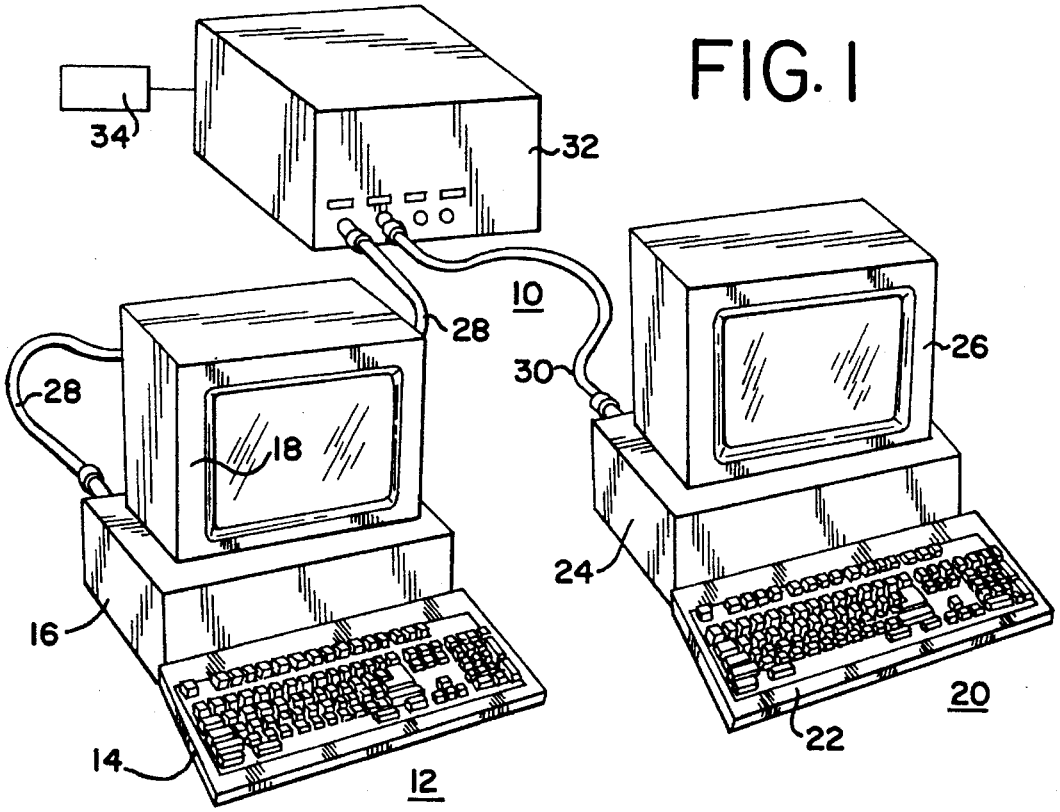
FIG. 1 illustrates a system for increased identification of traits according to a preferred embodiment of the present invention.

Referring to FIG. 1, a method and system for uniquely identifying indicia of traits of a participant is generally designated by reference numeral 10. The system 10 can be operated on a single computational device 12 that includes an input device 14, processing device 16 and display 18. However, an additional computational device 20 having input device 22, processing device 24 and display 26 can be added to offer unique advantages described herein. The system 10 of the present invention will be described in the later configuration having computational devices 12 and 20 connected by lines 28 and 30 to a hub 32 and a server 34 to form a local area network (LAN) where data can be transferred and shared using known network protocols. The present invention will be generally described in terms of a method and system for providing indicia of traits for participants in a boxing match, however, the present invention is not specifically limited to such, as other match events and their indicia of traits are contemplated such as basketball, horse racing, tennis or the like wherein these indicia of traits can be input, processed and displayed by the system 10 of the present invention. Throughout the following detailed description, the same reference numerals refer to the same elements in all figures.

Figure 2:
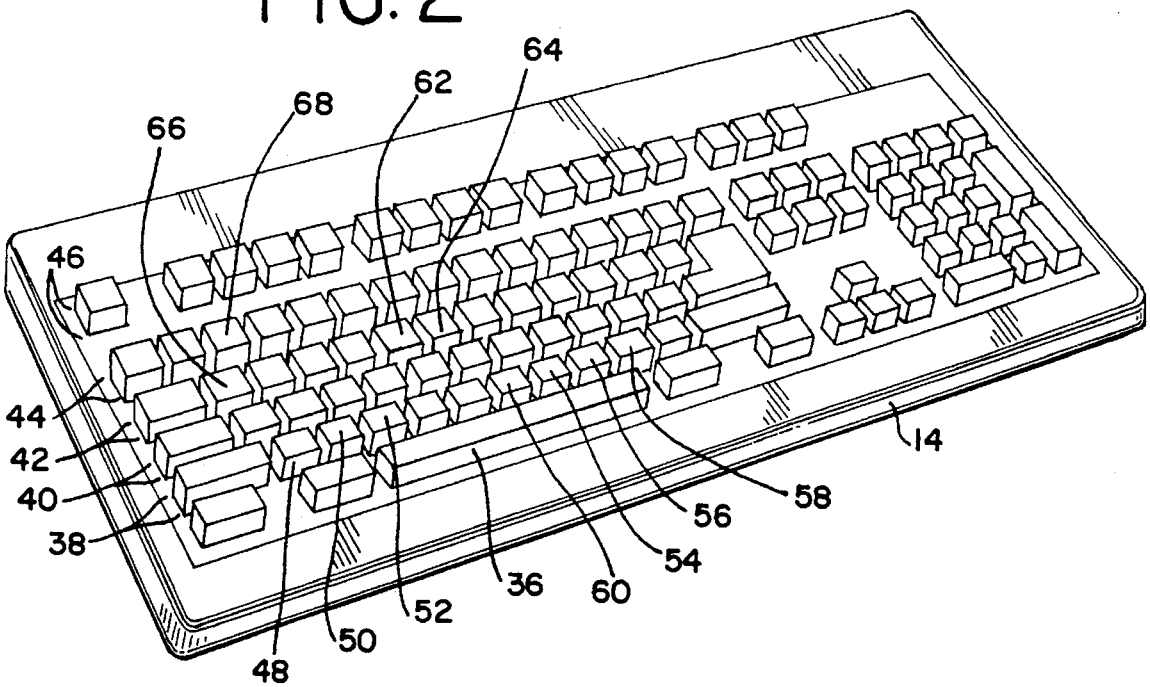
FIG. 2 illustrates an input device for entering a predetermined characteristic of a participant.

As illustrated in FIGS. 1 and 2, the input devices 14 and 22 can be utilized for entering each predetermined characteristic in a predefined format. FIG. 2 will describe the features of input devices 14 and 22 using the input device 14. The input 14 can be a keyboard or the like to enter specific traits of an individual boxer. Other input devices are contemplated so as to provide certain advantages, maximize input efficiency, and facilitate ease of operator training and learning. The geometry of the input device 14 is arranged to maximize effective, rapid and accurate input of data identifying certain traits of boxers. The input device 14 is configured to include first input 36 to designate any punches as a combination such as using a space bar. A second input 38 is configured to designate other information such as the types of punches and the timing of rounds. The third input 40 is configured to designate any punch as a body punch. A fourth input 42 and a fifth input 44 can be utilized to designate a predetermined number of specialized input of data such as knockout or knockdown information. A sixth input 46 can be used to switch between various formats of the display 18 or 26.

The second input 38 is configured to divide input between an operator's right and left hands. The operator's left hand can control input for a left jab 48, a right cross 50 and a left hook 52 having corresponding adjacent keys on input device 14. The operator's right hand can control input for a right or dominant hook 54, a left uppercut 56 and a right or dominant uppercut 58, having corresponding adjacent keys on the input device 14. The second input 38 also can be configured for controlling different inputs or characteristic information such as, for example, the system 10 can have input device 14 configured for a left-handed fighter while device 22 is configured for a right-hander. This is processed and displayed in accordance with the fighters dominant or leading hand. As such, the second input 38 can be alternatively configured to input boxing traits of left-handed boxers. It is evident that the left-handed boxer leads with a right jab rather using a left jab. Similarly, a right cross is used as well as other dominant hand punches. The second input 38 is then configured having the characteristics of a right jab, a left cross, a right hook, a left or dominant hand hook, a right uppercut and a left or dominant hand uppercut, e.g. as elements 48, 50, 52, 54, 56 and 58, respectively. Thus, the input 38 is configured to include a right jab 48 and a left cross 50 and other changes due to the increased use of a boxer's dominant hand, and can be displayed as illustrated in FIG. 4.

In this embodiment of the present invention, the operator can consistently use key 48 for a dominant hand or leading hand jab so as to facilitate following the boxer circling in the ring. Thus, the operator uses his or her left hand to correspond to the leading hand of the fighter considering the jab, whether left or right, which can also be the most frequently used punch. In an alternative embodiment of the present invention, the input for designating frequently used punch characteristics can be arranged on a typical boxer model wherein the center keys can designate the jab and cross punches using the operator's index fingers while less frequently used punches can be input by the second, third and fourth fingers adjacent to the index finger.

In addition, input 14 can include a timing input 60 operable by either hand to actuate the timing of a round. On the keyboard, the timing input 60 can be located near the center such as using the "B" key and easily remembered by the designation "begin" round. The third input 40 can be configured to designate a punch as a body punch such as using any letter key in the row of the third input 40.

In operation, once the timing of a round is actuated, the first input 36 can be used in conjunction with other input 38 and 40 during a boxing match. For example, the space bar 36 can define a packet or group of input dam so as to indicate a beginning and end of a series of combination punches. Having depressed the space bar, the second input 38 can input several of the six types of punches thrown, i.e., elements 48, 50, 52, 54, 56, or 58 as defined herein. The third input 18 can input when a punch of the second input 38 lands, for example, a body punch. After a flurry of punches, the first input 36 can be actuated to indicate the end of the combination. Other data can be rapidly input and grouped while the round timing input is actuated. For example, the fourth input 42 can indicate when a knockdown 62 or a knockout 64 has occurred. Additionally, an input 66 can be used to designate a left hook/right hook combination or the like when such a combination is used frequently and is desired to be recorded. Also, an input designated for a left uppercut/right uppercut 68 combination can be recorded.

Referring to FIG. 1, during a boxing match an operator located at computational device 12 can enter data information of a boxer's punches and other characteristics. Similarly, another operator can enter data on computational device 20. The data input is processed and displayed to show the characteristics or indicia of traits of individual boxers. The processing units 16 and 24 can display output information on displays 18 and 26 in a predefined format. The displayed indicia provides advantages wherein the side-by-side display of information for each boxer during the match, thereby indicating trends and other characteristics. The display in the predefined format of the present invention is particularly useful for coaching, scouting and competing.

The display devices 18 and 26 provide an operator with various predefined formats for inputting and displaying the above-described indicia of traits in the appropriate type of event to be analyzed. Referring to FIG. 3, a background information format 70 for inputting data is displayed. In the sequence of events, relevant background information is first entered by the operator in the appropriate subfields. In operation, input in the field 72 configures the input device 14 or 22 to designate operation of the second input 38 for left and right handed boxer indicia of traits during the fight stage. For example, the entry of a right handed boxer will designate the appropriate punches for that boxer at input 38. Thus, input 48 will be a left jab key whereas for a left-handed boxer input 48 will be for a right jab. Similarly, right cross input 50 will become a left cross input for a left handed boxer. Other inputs designated by 52, 54, 56 and 58 can be designated separately depending on which hand the boxer may lead with other desired indicia of traits.

The documentary information for a particular boxer entered in format 70 is stored in a permanent record using a database format. The background information format 70 includes fields for fight data 74, boxer's data 76 and fight record data 78. The fight data 72 sub fields can include the boxer's name, opponent's name, fight date, fight location, corner and scheduled rounds. The boxer's data 76 sub field can include the weight, reach, height, age, right handed/left handed designation 72 and hometown. The fight record data 78 can include the wins, losses, draws and knockouts. Each individual field can be updated through the keyboard. Function keys F2, F3 and F4 can be designated to save, edit and abort/no save. As above, data can be permanently stored and updated at a later time for individual participants. The introductory screen can further provide for selection of a new fight, updating an existing fight, printing boxer's statistics, printing fight statistics, or exiting/quitting the program.

Referring to FIG. 4, a fight round screen format 80 can provide a serial display of the second input 38 values as designated such as by above-described elements 48, 50, 52, 54, 56, 58. The format 80 facilitates the identification of patterns, for example, if an individual boxing participant always follows a left jab with a right cross. In addition, more complex patterns can be identified such as if a boxer has indicia of traits suggesting that he throws a plurality of combination punches, followed by a defensive posture for a predetermined number of punches. The fight round display 80 can include a reference scale 82 and 84 for advantageous use as an easy quantification reference of the number of punches thrown per minute for a particular boxer. The fight screen further provides tabulation fields 86, 88 and 90 configured to display, in a serial format, data entered via first and second input 36 and 38, for respectively, a first minute, second minute and third minute, respectively. Each of the tabulation displays 86, 88 and 90 can include a punch analysis field 92 located adjacent to the displayed tabulation fields 86, 88 and 90. The predefined serial format of display 80 provides for analysis of a boxer's punches using symbols designating and displaying a jab as a "1", a cross as a "2", a hook as a "3", a dominant hand hook as a "4", an uppercut as a "5", and a dominant hand uppercut as a "6". The second input 38 can enter punches configured for a left-handed boxer using the same symbols. While the display of FIG. 4 uses subfields to differentiate the dominant hand of the boxer, other symbol designations can be used to differentiate such as numbers, letters or other arbitrary symbols so as to provide increased ease of learning and an additional method of identifying indicia of traits and trends.

As illustrated in FIG. 4, the operator can interpret displayed symbols for a left jab "1" as shown in tabulation fields 86, 88 and 90. Likewise, fields 86, 88 and 90 indicate symbols for a left jab, a right cross, a left hook, a right hook, and a right uppercut as 2, 3, 4 and 6, respectively. From the serial format, the operator can infer that the boxer tends to not use a left uppercut, because the symbol "5" is not displayed, but would be if it had been used. Also apparent from the display 80 is the indicia of the beginning and ending of a combination, for example, symbols of a "("represents the beginning, and a")" represents the end of a combination. A knockout symbol 94 is displayed as "KO" and a "–" symbol represents a body punch. In use, the displayed symbols offer unique advantages. An equal distribution of even and odd symbols advantageously indicates a boxer/slugger style of a participant. Additionally, boxers tend to have more odd symbols, whereas sluggers tend to have even symbols as a means for identifying indicia of these traits.

The serial display of each punch shown in display 80 begins and ends with the depression of timing input 60. The fields 86, 88 and 90 can display information and provide an indication of factors such as stamina or patterns such as if a participant alternates between slugging and boxing on odd and even minutes, respectively. The punch analysis display 80 provides advantages of a continuous indication of particular punches, thereby permitting direct observation of patterns, trends and competitive condition of the boxer. Quantification can also be given to the skill level of a boxer by the identification of certain combinations.

Figure 5:
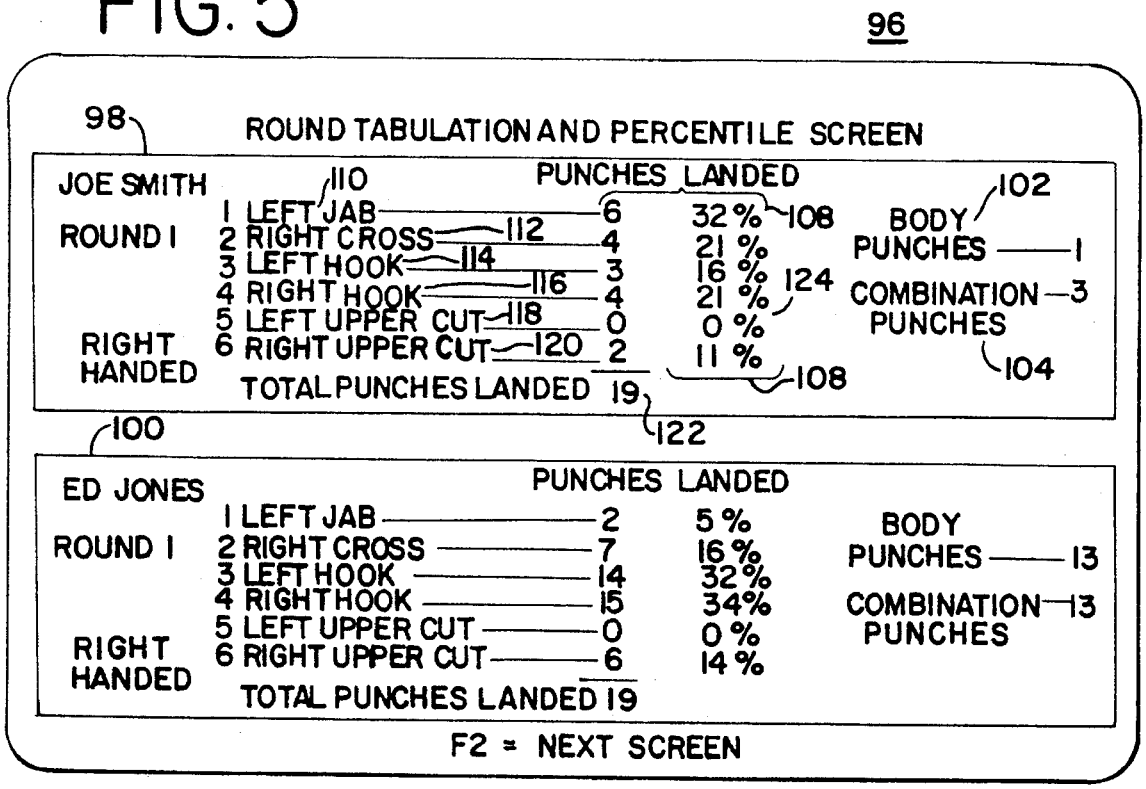
FIG. 5 illustrates a round tabulation and percentage display.

As illustrated in FIG. 5, a round tabulation and percentage display format 96 includes a first field portion 98 and a second field portion 100. These are displayed adjacent each other and having data information displayed for an individual participant in each of the portions 98 and 100. The displayed order of portions 98 and 100 can be reversed on display 18 and display 26 as desired by each operator because a particular operator is entering data for a particular participant and may desire such information appearing in the upper portion of display 96. Each of the portions 98 and 100 are configured to contain certain indicia of traits of a particular boxer having the event. The portion 98 contains information for one participant for each round for example round one. Information can include right handedness wherein the symbols 1–6 will represent left jab, right cross, left hook, right hook, left uppercut, and right uppercut, respectively. Left handedness is designated using the symbols 1–6 representing a right jab, left cross, right hook, left hook, right uppercut, and right uppercut, respectively. In addition, the portion 98 can include information of the total punches landed and percentile of landing. Individual subfields include a body punch display 102, combination punch display 104 and total the number of these punches 106. Area 108 displays a punches thrown and landed tabulation. Individual sub-fields of the punches/landed area 108 include left jab 110, right cross 112, left hook 114, right hook 116, left uppercut 118, and right uppercut 120. The above-mentioned tabulations are totalled at the total punches landed display 122. The landed portion of area 108 provides an interpretation of the relative percentages 124 of punches landed for each round. In the preferred embodiment, the display 96 can be shown or presented to the operator at the conclusion of a round, for example, immediately following the round fight display of FIG.4.

Figure 6:
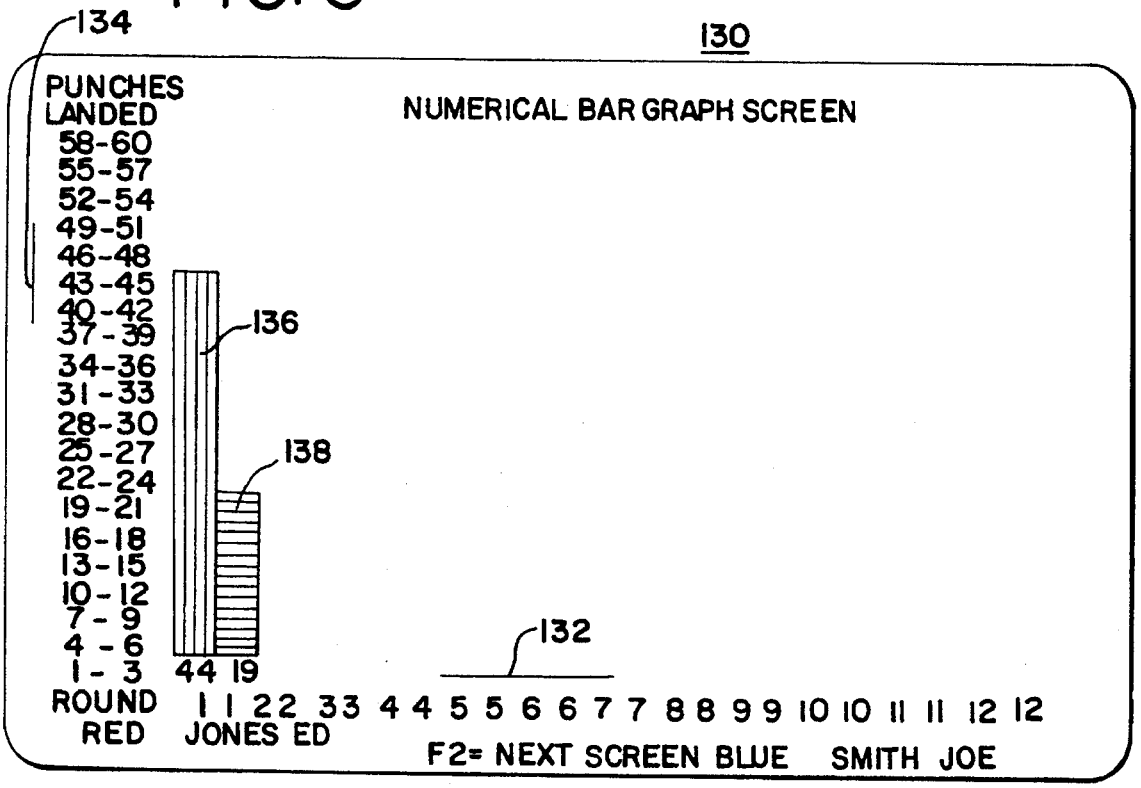
FIG. 6 illustrates a display for identifying indicia of a participant.

As illustrated in FIG. 6, the present invention provides for a numerical bar graph display generally designated as 130. The display 130 includes an X-axis 132 and Y-axis 134. The X-axis 132 includes an incremental scale illustrating round-by-round increments, for example, each column represents an individual competitors efforts per round. The Y-axis 134 is scaled in three punch increments and illustrates the punches landed per each competitor. The display 130 includes bars 136 and 138 for each boxer or competitors. The bars 136 and 138 can be of different colors to facilitate differentiation. Each of the bars 136 and 138 display a quantity corresponding to the total number of calculated punches having the information totalled and shown on the rounded tabulation and percentage display 96, as shown in FIG. 5. The display 130 has the advantage of providing a graphical representation for rapid visual comparison of the effectiveness of a particular competitor's punching. The graphical display 130 will be provided throughout the fight and the final round display (not shown) of display 130 can provide for additional menu selections to input the type of fight result. Fights can result in a unanimous or split decision, technical knockout, a knockout, draw or a disqualification. The final round display can include menus for the type of result and an individual boxer result. The menu for an individual boxer result simply records the win or lose for each respective boxer, and can be input using the input device 14. The final round display can include tabulation displays to re-display certain information of the round tabulation and percentage display 90 which can include the additional field 140 to define a competitors boxing propensity, for example, a boxer, slugger or the like. The added field 140 provides for rapid and objective characterization of boxers usable in coaching, scouting and competitive purposes.

Additionally, the present invention can include other information than shown in FIG. 3. Additional administrative screen fields can be provided to prompt and give options from a main menu to record and compile inputted information. It is further complicated that the operator can be able to search for information by the name of a boxer or a fight date. Once information is recorded and maintained in a database, reports may be generated in graphic form. Input information can be printed out serially or as reports to provide information for training archival purposes or the like. Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A method of identifying indicia of traits of a first participant in an event with the aid digital computer, said method comprising the steps of:

providing said computer with a database for said indicia of traits including at least, a plurality of predetermined characteristics corresponding to traits of said participant;

entering serially each of said predetermined characteristics using an input device connected to said computer as often as occurring in the event;

converting and outputting said serially entered input to a plurality of predefined symbols; and displaying said predefined symbols in a plurality of predefined display formats;

actuating a means for timing a predetermined interval, said timing means being actuated using said input means;

serially entering each of said predetermined characteristics;

said step of serially entering each of said predetermined characteristics further includes the step of:

entering a characteristic for the occurrence of each of the punches of a jab, a cross, a hook, a dominant hook, an uppercut and a dominant uppercut said step of serially entering each of said predetermined characteristics further includes the step of:

entering a characteristic for the occurrence of a body punch;

entering a characteristic of a grouping upon the occurrence of a combination of said predetermined characteristics;

said predefined display formats further comprising a first screen having unit, relative proportion and time indications for said traits for said first participant, a second screen having both unit and relative proportion indicators for said traits for said first participant and a second participant and a third screen having both unit and relative proportion indications for the totals of said traits for said first participant and for said second participant.

2. The method of claim 1 wherein said converting and outputting step further includes the step of:

converting and outputting said serially input predetermined characteristics to a set of symbols defining a jab as "1", a cross as "2", a hook as "3", a dominant hook as "4", an uppercut as "5" and a dominant uppercut as "6".

3. The method of claim 2, wherein said convening and outputting step further includes the step of:

converting and outputting said predetermined characteristic for said body punch as a "–".

4. The method of claim 3, wherein said converting and outputting step further includes the step of:

converting and outputting said predetermined characteristic for said grouping as a "("for a start of said combination, and a")" for an end of said combination.

5. The method of claim 1 wherein said displaying step includes the step of:

displaying said plurality of predefined symbols in fight round display format.

6. The method of claim 1 wherein said displaying step includes the step of:

displaying said plurality of predefined symbols in a round tabulation and percentage display format.

7. The method of claim 1 wherein said displaying step includes the steps of:

calculating the punches landed per round; and displaying said calculation of said punches landed per round in a numerical bar graph screen display format.

8. A system for identifying indicia of trends of a plurality of participants in an event, comprising:

input means for inputting a plurality of predetermined characteristics, said input means being actuated upon the occurrence of each of said predetermined characteristics;

processing means for processing each of said predetermined characteristics as entered by said input means, said processing means converting and outputting a plurality of symbols corresponding to said inputted predetermined characteristics;

display means for displaying said symbols in a plurality of predefined display formats, said display formats providing an improved means for identifying traits of the participant in the event;

wherein said predetermined characteristics being configured for punches of a jab, a cross, a hook, a dominant hook, an uppercut and a dominant uppercut;

said input means includes means for designating a group of predetermined characteristics as a combination;

said input means including means for designating a body punch;

said input means including a first input device for inputting the performance traits of a first participant and a second input device for inputting the performance of a second participant;

said plurality of predefined symbols having said predetermined characteristics defining a jab as first symbol, a dominant cross as second symbol, a hook as a third symbol, a dominant hook as a fourth symbol, an uppercut as fifth symbol, and a dominant uppercut as sixth symbol;

said plurality of predefined symbols having said predetermined characteristics defining a body punch using a seventh symbol, and a grouping using an eighth symbol for a start of said combination and a ninth symbol for an end of said combination;

said predefined display format includes a fight round display format for displaying said predefined symbols so as to allow substantially real time identification of unit, relative and trend indicia of traits of the participant in the event over selected time intervals and fractions of said time intervals;

said predefined display format includes a round tabulation and display format for displaying said predefined symbols so as to allow identification of indicia of unit and relative traits of the participant in the event.

9. A method for providing analytical indicia enabling relative comparison of first and second participants in an event, said participants being bilaterally symmetric on first and second sides about a principal axis and said participants having a plurality of selected traits, comprising:

recording pre-event identifying data and the presences of any favoring by one of said participants of one of said sides and displaying said information as a first display;

assigning a value to each of said traits in association with each of said sides;

serially recording the value of the trait and side upon occurrence of each trait on each side as it occurs during the course of the event and displaying said serial recordal as a second display said second display further providing said information over the time of the event subdivided into round time intervals and fraction of round time intervals;

providing a determination of the relative occurrence as between said first participant and said second participant of said values of said traits and displaying said determination corresponding to each participant, each trait and each side, as a third display;

providing a graphic display of the relative occurrence of the totals of said values of said traits corresponding to each participant, as a fourth display;

said method being adapted to selectively refer to each of said first, second, third and fourth displays to provide indicia of patterns and trends in the occurrence of said traits;

said method being further adapted to provide said selective reference in real time during the occurrence of the event and having said time related displays broken down in a manner meaningful to the planning of the future conduct of the event or a like event by one of the participants or a third party.

10. The method according to claim 9, further comprising:

said event being one event in a plurality of events;

said serial recording occurring for each event in said plurality and said second display providing indicia of said recording for each of said events;

said determination of relative occurrence of traits occurring for each event in said plurality and third display providing indicia of said determination for each of said events;

said display of said relative occurrence of traits occurring for each event in said plurality and fourth display providing indicia of said display for each of said events;

providing a determination of the relative occurrence of said values of said traits in the total of said plurality of events and displaying said total determination corresponding to each participant, each trait and each side, as a fifth display;

providing a graphic display of the relative occurrence of said values of said traits corresponding to each participant, each trait and each side, in the totality of said plurality of events as a sixth display.

11. The system of claim 8, wherein said predefined display format includes a fight round display format for displaying said predefined symbols so as to allow identification of indicia of traits of the participant in the event.

12. The system of claim 8, wherein said predefined display format includes a round tabulation and display format for displaying said predefined symbols so as to allow identification of indicia of traits of the participant in the event.

13. The system of claim 8, wherein said processing means further includes calculating means for calculating and outputting punches landed per round; and wherein said display means displaying said outputted punches landed per round in a predefined display format of numbered bar graph display.

* * * * *